US007823874B2

(12) United States Patent
Fuchi

(10) Patent No.: US 7,823,874 B2
(45) Date of Patent: Nov. 2, 2010

(54) PAPER FEEDER

(75) Inventor: Masami Fuchi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 12 days.

(21) Appl. No.: 12/199,170

(22) Filed: Aug. 27, 2008

(65) Prior Publication Data

US 2009/0057989 A1 Mar. 5, 2009

(30) Foreign Application Priority Data

Aug. 31, 2007 (JP) ..... 2007-226249

(51) Int. Cl.
*B65H 1/18* (2006.01)

(52) U.S. Cl. ..... 271/152; 271/164

(58) Field of Classification Search ..... 271/152–156, 271/3.15, 4.02, 10.02, 110, 111, 145, 162, 271/164, 38; 399/393; 270/58.09
See application file for complete search history.

(56) References Cited

U.S. PATENT DOCUMENTS 4,888,617 A * 12/1989 Okuzawa ..... 355/400
5,405,129 A * 4/1995 Mihara et al. ..... 271/111
5,897,112 A * 4/1999 Kwag ..... 271/38
6,152,443 A * 11/2000 Claramunt et al. ..... 271/258.05
6,170,821 B1 * 1/2001 Kubota ..... 271/288
6,279,899 B1 * 8/2001 Coffey et al. ..... 271/220
6,292,636 B1 * 9/2001 Kwon ..... 399/16
6,651,977 B2 * 11/2003 Tanaka ..... 271/154
6,659,449 B2 * 12/2003 Kim ..... 271/117
2004/0041329 A1 * 3/2004 Hiraoka ..... 271/110
2004/0195757 A1 * 10/2004 Lyu et al. ..... 271/110
2006/0087070 A1 * 4/2006 Cook et al. ..... 271/145
2009/0129790 A1 * 5/2009 Kang ..... 399/23

FOREIGN PATENT DOCUMENTS

JP 02066028 A * 3/1990
JP 05077965 A * 3/1993
JP 05105274 A * 4/1993
JP 2002-284367 10/2002

* cited by examiner

*Primary Examiner*—Richard W Ridley
*Assistant Examiner*—Jeremy Severson
(74) *Attorney, Agent, or Firm*—The Webb Law Firm

(57) ABSTRACT

A paper feeder comprising an actuator and a sensor mounted on a main body, the actuator being capable of contacting an upper surface of a sheet placed on a bottom plate provided in a sheet tray as the bottom plate is raised, thereby allowing the sensor to detect that the sheet is present. The paper feeder further comprises a through bore formed in the bottom plate for receiving the actuator when a sheet is absent from the sheet tray, so that the sensor may detect that the sheet is absent, and a push-out guide provided on peripheries of the through bore for contacting the actuator in the through bore as the sheet tray is pulled out, thereby pushing the actuator upward out of the through bore.

1 Claim, 8 Drawing Sheets

(a)

(b)

PAPER FEEDER

CROSS REFERENCE TO RELATED APPLICATIONS

The present application claims priority from JP 2007-226249 filed by the same applicant on Aug. 31, 2007 in Japan, the entire disclosure of which is hereby incorporated herein by reference.

BACKGROUND OF THE INVENTION

1. Field of the Invention

The present invention relates to a paper feeder comprising a sheet tray provided along a guide portion mounted on a main body of an image forming apparatus and capable of being pushed in and pulled out in horizontal directions with respect to the main body; a bottom plate provided inside the sheet tray to be vertically movable; an elevating device for raising the bottom plate as the sheet tray is pushed into the main body and lowering the bottom plate as the sheet tray is pulled out of the main body; the main body having an actuator capable of contacting an upper surface of a sheet placed on the bottom plate as the bottom plate is raised, and a sensor capable of detecting the sheet on the sheet tray based on the actuator contacting the upper surface of the sheet; and a through bore or a recess formed in the bottom plate for receiving the actuator when the sheet tray is empty of a sheet, for enabling the sensor to detect that the sheet tray is empty of a sheet.

2. Description of the Related Art

With the paper feeder noted above, the bottom plate mounted inside the sheet tray is raised when the sheet tray is pushed into the main body of the image forming apparatus, to move an uppermost one of the sheets stacked on the bottom plate to a predetermined vertical position for feeding, and the actuator mounted on the main body contacts the upper surface of the sheets placed on the bottom plate whereby the sensor detects that the sheets are present. The through bore or recess is formed in the bottom plate for receiving the actuator when sheets are absent in order to prevent the sensor from erroneously detecting that sheets are present due to contact between the actuator and the bottom plate. As the actuator moves into the through bore or recess, the sensor detects that the sheets are absent.

When the sheet tray is forced out of the main body in a state where the sensor detects that sheets are absent with the actuator lying in the through bore or recess, the actuator will collide with peripheries of the bottom plate surrounding the through bore or recess due to the pull-out operation, which can cause damage. In view of this, the elevating device is provided to raise the bottom plate as the sheet tray is pushed into the main body, and to lower the bottom plate as the sheet tray is pulled out of the main body.

However, when the sheet tray is pulled out at a speed faster than a descending speed of the bottom plate, i.e., when the sheet tray is forcibly pulled out before the bottom plate descends sufficiently or before the actuator of the main body moves out of the through bore or recess, the actuator may collide with the peripheries of the bottom plate due to the pull-out operation, and can be damaged.

In view of the above, the conventional paper feeder controls the operation of the elevating device so that the bottom plate descends to a predetermined vertical position where the actuator moves out of the through bore or recess as the sensor detects that sheets are absent thereby preventing the actuator from colliding with the peripheries of the bottom plate when the sheet tray is pulled out of the main body (see Japanese laid-open Publication No. 2002-284367, for example).

This disadvantageously complicates the controlling structure of the elevating device. In addition, if the sheet tray is forcibly pulled out of the main body immediately after the sensor detects that the sheets are absent and before the actuator is completely out of the through bore or recess, there still remains the possibility that the actuator is damaged by collision with the peripheries of the bottom plate.

SUMMARY OF THE INVENTION

The present invention has been made having regard to the above-noted drawbacks, and its object is to avoid damage to an actuator by alleviating a shock occurring in collision between the actuator and peripheries of a bottom plate without controlling operation of an elevating device particularly when a sheet tray is forcibly pulled out of a main body of an image forming apparatus before the actuator mounted on the main body is completely out of a through bore or recess.

A first aspect of the present invention lies in a paper feeder comprising:

a sheet tray provided along a guide portion mounted on a main body of an image forming apparatus and capable of being pushed in and pulled out in horizontal directions with respect to the main body;

a bottom plate provided inside the sheet tray to be vertically movable;

an elevating device for raising the bottom plate as the sheet tray is pushed into the main body and lowering the bottom plate as the sheet tray is pulled out of the main body;

the main body having an actuator capable of contacting an upper surface of a sheet placed on the bottom plate as the bottom plate is raised, and a sensor capable of detecting the sheet on the sheet tray based on the actuator contacting the upper surface of the sheet;

a through bore or a recess formed in the bottom plate for receiving the actuator when the sheet tray is empty of a sheet, for enabling the sensor to detect that the sheet tray is empty of a sheet; and a push-out guide provided on peripheries of the through bore or the recess for contacting the actuator lying in the through bore or the recess as the sheet tray is pulled out, thereby pushing the actuator upward out of the through bore or the recess.

The above construction includes the push-out guide provided on the peripheries of the through bore or the recess to contact the actuator lying in the through bore or recess as the sheet tray is pulled out, thereby pushing the actuator upward out of the through bore or recess. When the sheet tray is forcibly pulled out of the main body before the actuator mounted on the main body is completely out of the through bore or recess, the actuator lying in the through bore or recess contacts the push-out guide provided on the peripheries of the through bore or recess to be pushed up out of the through bore and recess due to the pull-out operation.

Thus, it is possible to avoid damage to the actuator by alleviating a shock occurring in collision between the actuator and the peripheries of the bottom plate without controlling operation of the elevating device, particularly when the sheet tray is forcibly pulled out of the main body of the image forming apparatus before the actuator mounted on the main body is completely out of the through bore or recess.

A second aspect of the present invention lies in that the actuator is oscillatable about an axis extending generally along a pull-out direction of the sheet tray, and that the push-out guide includes an edge portion of peripheries of the through bore or the recess for facing the actuator lying in the through bore or the recess from an upstream side in the pull-out direction, the edge portion being formed in a direction inclined with respect to the pull-out direction.

Since the actuator is oscillatable about the axis extending generally along a pull-out direction of the sheet tray, the actuator substantially constantly contacts a predetermined position on the upper surface of sheets placed on the bottom plate in the pull-out direction of the sheet tray, as a result of which the detecting accuracy of the sensor is easily enhanced.

Further, in this construction, the push-out guide includes the edge portion of the peripheries of the through bore or recess to face the actuator lying in the through bore or recess from the upstream side in the pull-out direction, the edge portion being formed along the direction inclined with respect to the pull-out direction. When the sheet tray is forcibly pulled out of the main body of the image forming apparatus before the actuator mounted on the main body is completely out of the through bore or recess, the edge portion inclined with respect the pull-out direction contacts the actuator in the through bore or recess due to the pull-out operation. As a result, a component force produced in a direction generally perpendicular to the pull-out direction is applied to the actuator, thereby oscillating the actuator about the axis generally along the pull-out direction and pushed upward out of the through bore or recess while alleviating the shock occurring in collision between the actuator and the peripheries of the bottom plate.

A third aspect of the present invention lies in that the actuator is oscillatable about an axis extending generally perpendicular to a pull-out direction of the sheet tray, and that the push-out guide includes a wall surface of a side wall portion of peripheries of the through bore or the recess to face the actuator lying in the through bore or the recess from an upstream side in the pull-out direction, the wall surface being formed as an inclined side surface progressively higher toward the upstream side in the pull-out direction.

Since the actuator is oscillatable about the axis extending generally perpendicular to the pull-out direction of the sheet tray, the actuator substantially constantly contacts a predetermined position on the upper surface of the sheets placed on the bottom plate in the direction generally perpendicular to the pull-out direction of the sheet tray, as a result of which the detecting accuracy of the sensor is easily enhanced.

Further, in this construction, the push-out guide includes the wall surface of the side wall portion of the peripheries of the through bore or recess to face the actuator lying in the through bore or recess from the upstream side in the pull-out direction, the wall surface being formed as an inclined side surface progressively higher toward the upstream side of the pull-out direction. When the sheet tray is forcibly pulled out of the main body of the image forming apparatus before the actuator mounted on the main body is completely out of the through bore or recess, the wall surface formed as the inclined side surface progressively higher toward the upstream side of the pull-out direction contacts the actuator lying in the through bore or recess due to the pull-out operation. As a result, a component force acting upward with respect to the pull-out direction is applied to the actuator, thereby oscillating the actuator about the axis extending generally perpendicular to the pull-out direction, and pushing the actuator upward out of the through bore or recess while alleviating the shock occurring in collision between the actuator and the peripheries of the bottom plate.

BRIEF DESCRIPTION OF THE DRAWINGS

FIG. 3(*b*) is a rearward perspective view of the actuator;

FIG. 8(*b*) is a side view of the principal portion of the paper feeder in the third embodiment;

FIG. 9(*b*) is a side view of the principal portion of the paper feeder in the fourth embodiment.

DESCRIPTION OF THE PREFERRED EMBODIMENTS

Preferred embodiments of the present invention will be described hereinafter with reference to the drawings.

First Embodiment

Figure 1:
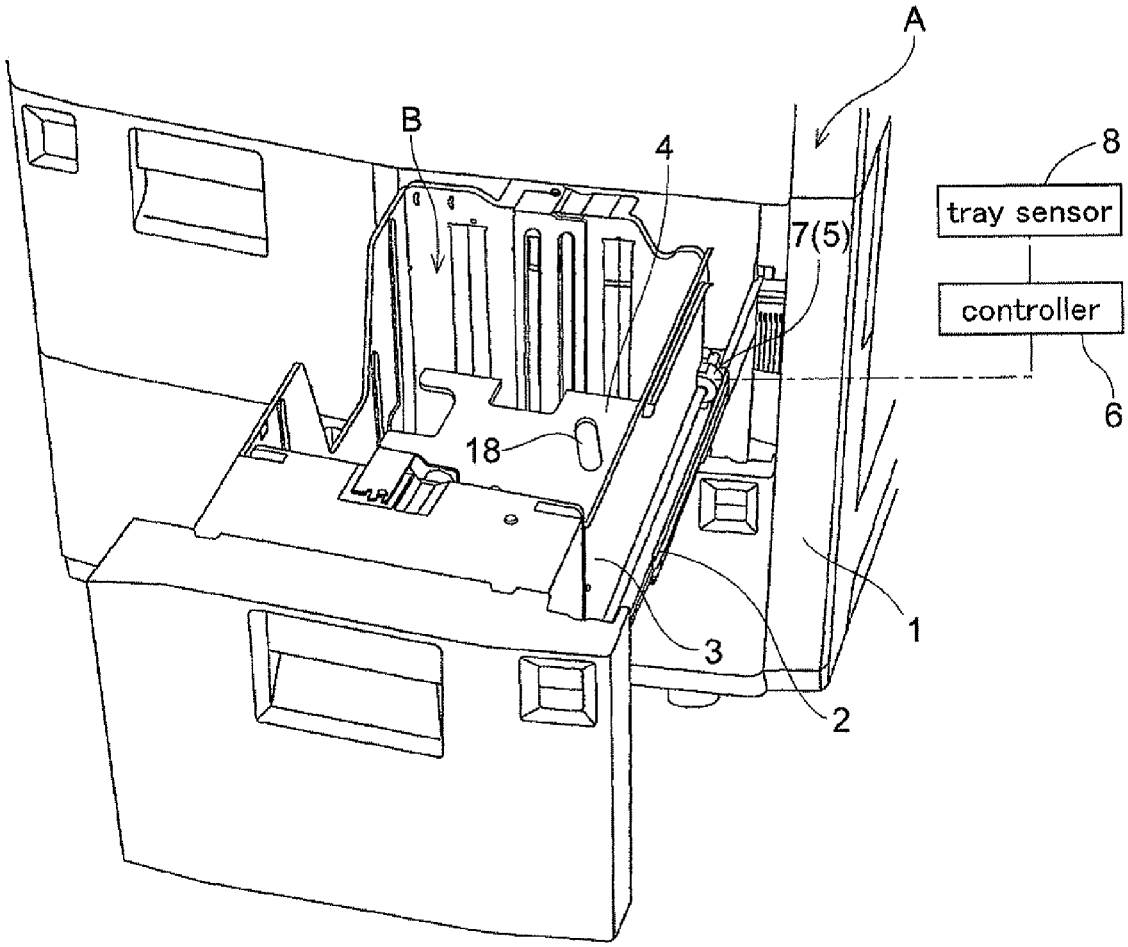
FIG. 1 is a perspective view of a principal portion of an image forming apparatus.

FIG. 1 shows a principal portion of an electrophotographic copier A as an example of image forming apparatus. The copier A is equipped with a paper feeder B in accordance with the present invention.

The paper feeder B comprises a sheet tray 3 provided along a guide portion 2 mounted on a main body 1 of the copier A and capable of being pushed in and pulled out in horizontal directions of the main body 1 at a front side thereof, a bottom plate 4 provided inside the sheet tray 3 to be vertically movable, an elevating device 5 for vertically moving the bottom plate 4, and a controller 6 for controlling operation of the elevating device 5.

The elevating device 5 is a known device with an electric motor 7 for winding and unwinding wires suspending the bottom plate 4, thereby vertically moving the bottom plate 4. A tray sensor 8 is provided in the main body 1 for detecting the sheet tray 3 pushed into the main body 1. The controller 6 controls operation of the elevating device 5 by driving the electric motor 7 to raise the bottom plate 4 when the tray sensor 8 detects the sheet tray 3 and to lower the bottom plate 4 when the tray sensor 8 no longer detects the sheet tray 3 with an operation to pull the sheet tray 3 out of the main body 1.

The elevating device 5 may have a conventional construction including a wire shaft provided on the sheet tray 3 for winding and unwinding wires, the electric motor 7 provided in the main body 1, and a drive connecting device (such as a coupling, a gear, etc.) for transmitting drive from the electric motor 7 to the wire shaft.

With this construction, the drive connecting device is connected with the sheet tray 3 being pushed into the main body 1 to rotate the wire shaft by the electric motor 7, thereby to raise the bottom plate 4 The drive connecting device is released when the sheet tray 3 is pulled out of the main body 1, thereby to lower the bottom plate 4 by gravity.

Figure 2:
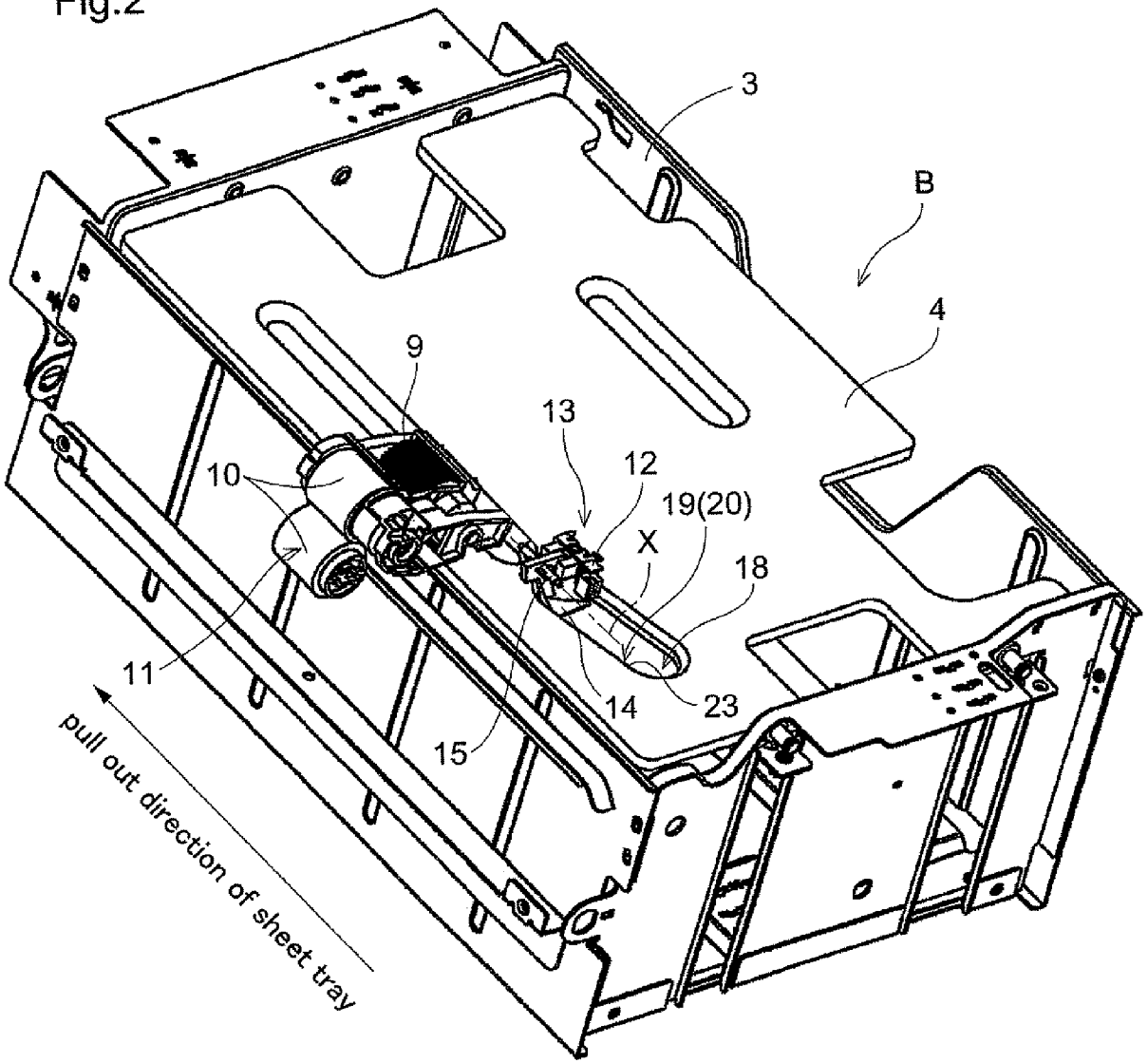
FIG. 2 is a perspective view of a principal portion of a paper feeder.

As shown in FIG. 2, the main body 1 includes a sheet feeding unit 11 having a drawer roller for drawing out sheets placed on the sheet tray 3, and a pair of sheet feeding rollers 10 for feeding the drawn sheets to an image forming station. (not shown), and a sensor unit 13 having a sheet sensor 12 such as a photo sensor capable of detecting presence of sheets on the sheet tray 3.

Figure 3:
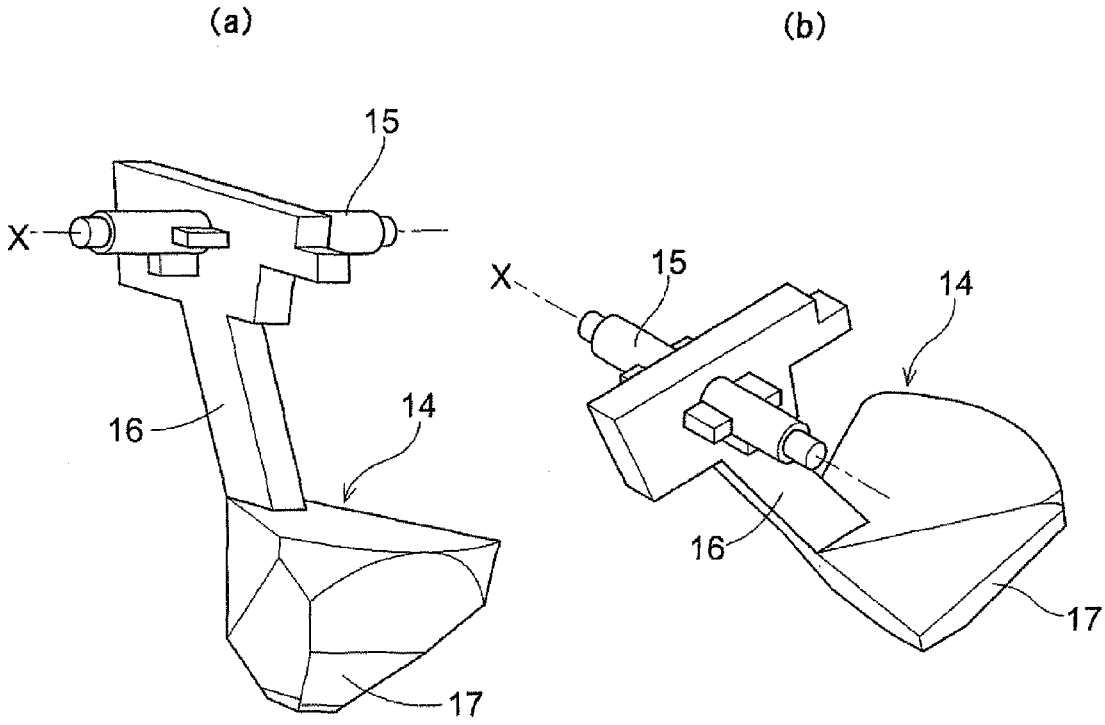
FIG. 3(*a*) is a forward perspective view of an actuator.

The sensor unit 13 has an actuator 14 supported to be oscillatable about an axis X extending generally along a pull-out direction of the sheet tray 3. The sheet sensor 12 is constructed to detect presence of sheets based on an oscillated posture of the actuator 14. As shown in FIGS. 3(*a*) and 3(*b*), the actuator 14 has a one-piece construction including a support shaft member 15, an arm member 16 extending radially from the support shaft member 15, and a detecting member 17 formed integrally with the arm member 16 at a distal end thereof.

Figure 4:
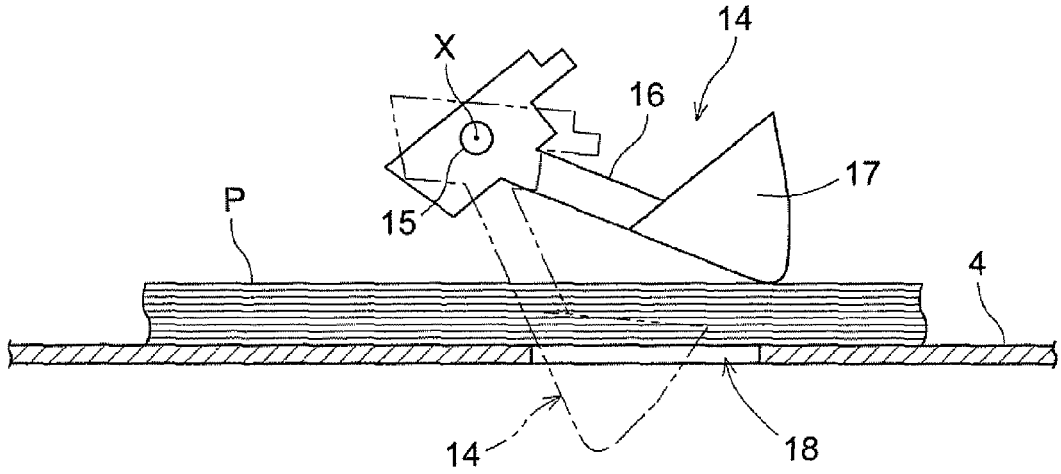
FIG. 4 is a side view of a principal portion of the paper feeder.

More particularly, as shown in FIG. 4, the detecting member 17 contacts an upper surface of sheets of paper P placed on the bottom plate 4 as the bottom plate 4 is raised, thereby oscillating the actuator 14 to a predetermined position, as a result of which the sheet sensor 12 detects that the sheets P are present on the sheet tray 3. On the other hand, as shown in FIG. 2, when the sheets P are not present on the sheet tray 3, the sheet sensor 12 detects that the sheets P are absent from the sheet tray 3 based on an oscillated position of the actuator 14 where the detecting member 17 lies in a through bore 18 formed in the bottom plate 4 for receiving the detecting member 17. Corresponding information is presented on a display section of a control panel (not shown).

A push-out guide 19 is provided on peripheries of the through bore 18 for contacting the detecting member 17 lying in the through bore 18 and pushing the actuator 14 upward out of the through bore 18 as the sheet tray 3 is pulled out of the main body 1.

Figure 5:
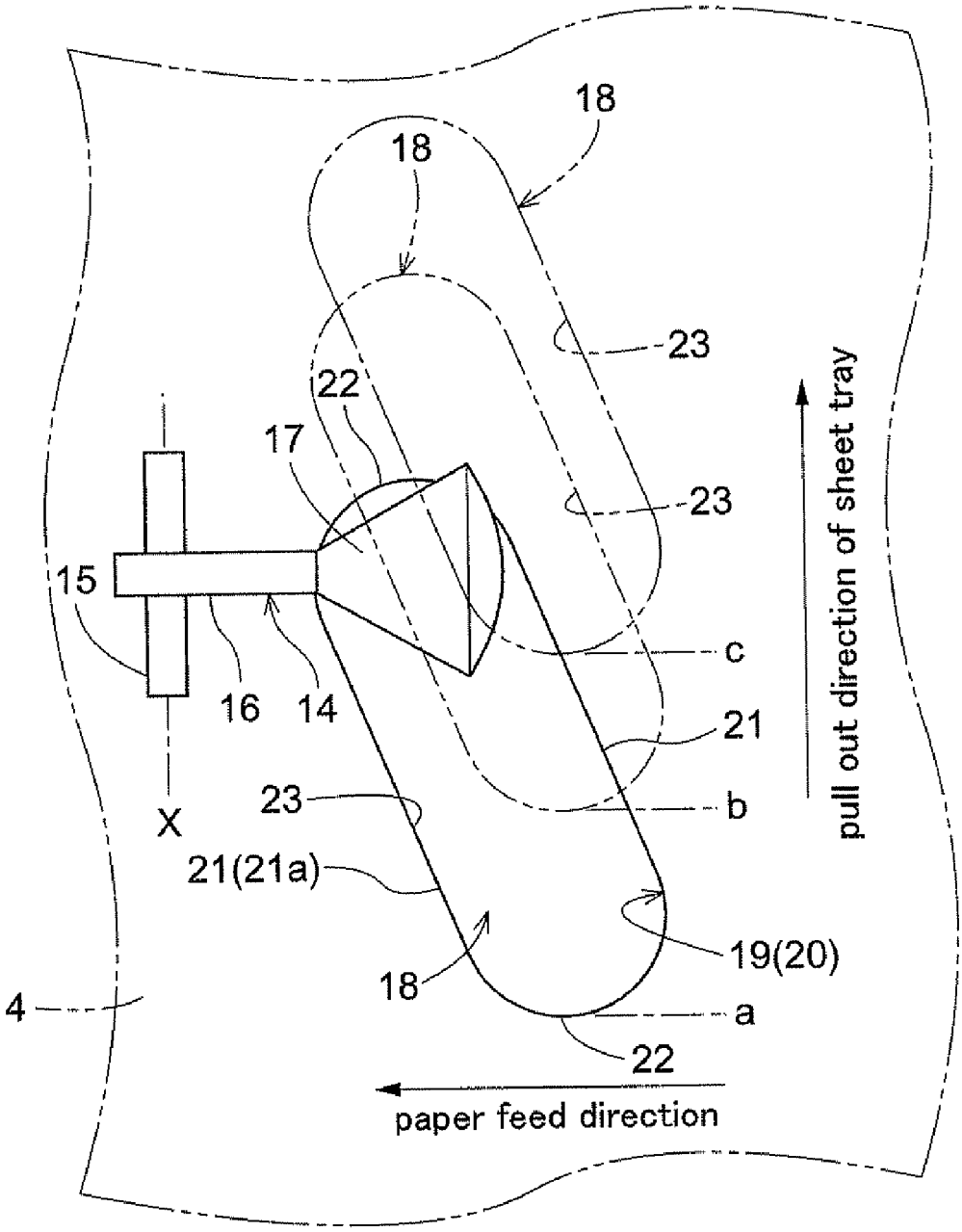
FIG. 5 is an explanatory view showing operation of the paper feeder.

As shown in FIG. 5, the push-out guide 19 includes straight edge portions 20 of the peripheries 23 of the through bore 18 facing the detecting member 17 lying in the through bore 18, from the upstream side of the pull-out direction of the sheet tray 3. The straight edge portions 20 extend in a direction inclined with respect to the pull-out direction.

More particularly, the through bore 18 is formed as a slot with the peripheries 23 having a pair of parallel edge portions 21 inclined with respect to the pull-out direction and arcuate edge portions 22 continuous with opposite ends of the parallel edge portions. The push-out guide 19 includes one of the parallel edge portions 21*a* facing the detecting member 17 lying in the through bore 18 from the upstream side in the pull-out direction.

Figure 6:
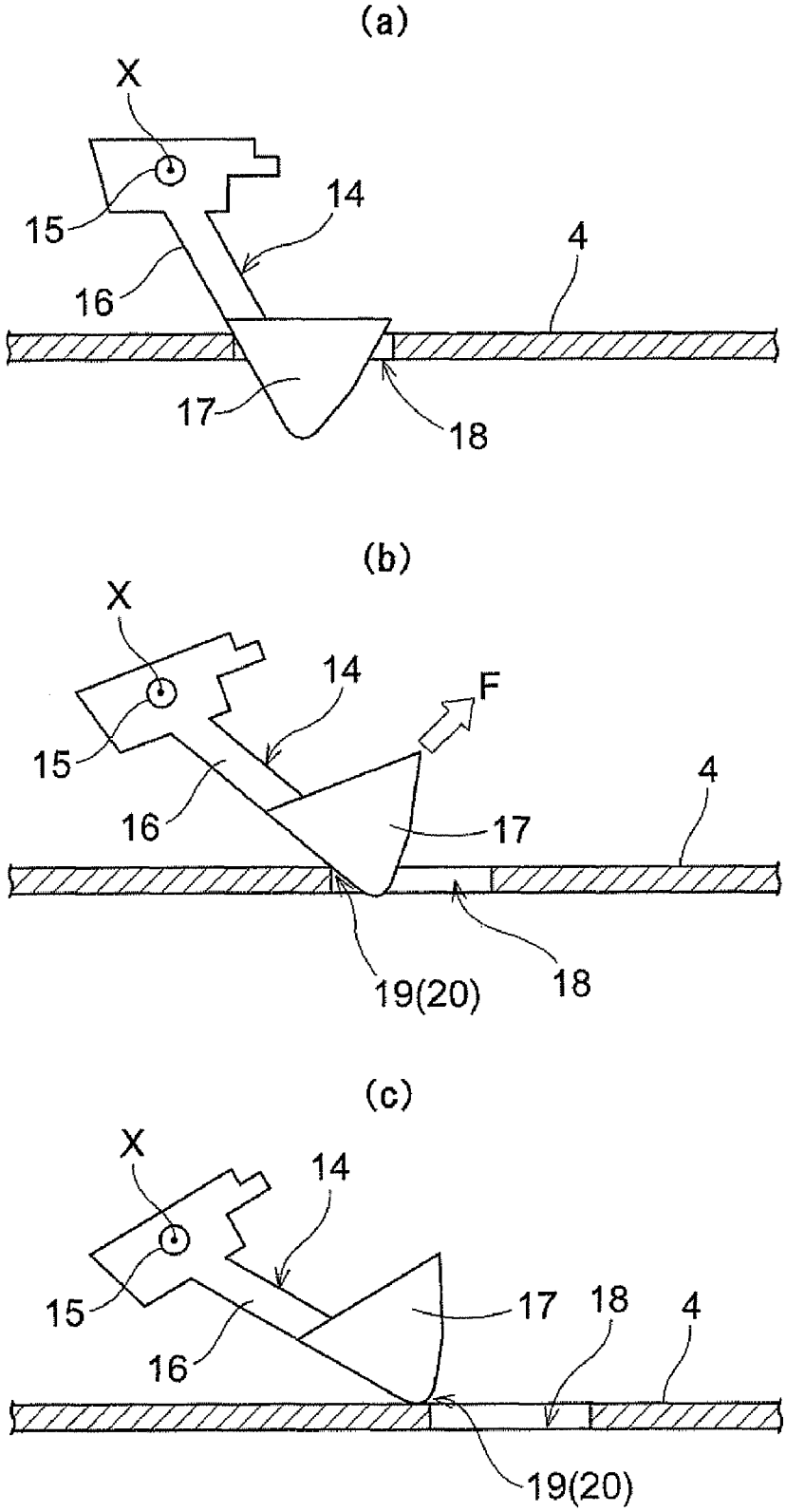
FIG. 6 is a series of explanatory views showing operation of the paper feeder.

Therefore, as the sheet tray 3 is pulled out of the main body 1 in a state shown in FIG. 6(*a*) where the detecting member 17 lies in the through bore 18 to detect that sheets are absent, the push-out guide 19 contacts a side surface of the detecting member 17 to apply a component force F in a direction generally perpendicular to the pull-out direction to the detecting member 17 as shown in FIG. 6(*b*), thereby oscillating the actuator 14 about the axis X extending generally along the pull-out direction. As a result, the actuator 14 can be pushed upward out of the through bore 18 while alleviating a shock caused by collision between the detecting member 17 and the peripheries of the bottom plate.

FIG. 6(*a*) shows a positional relationship between the actuator 14 and the through bore 18 in a position "a" in FIG. 5. FIG. 6(*b*) shows a positional relationship between the actuator 14 and the through bore 18 in a position "b" in FIG. 5. FIG. 6(*c*) shows a positional relationship between the actuator 14 and the through bore 19 in a position "c" in FIG. 5.

Second Embodiment

Figure 7:
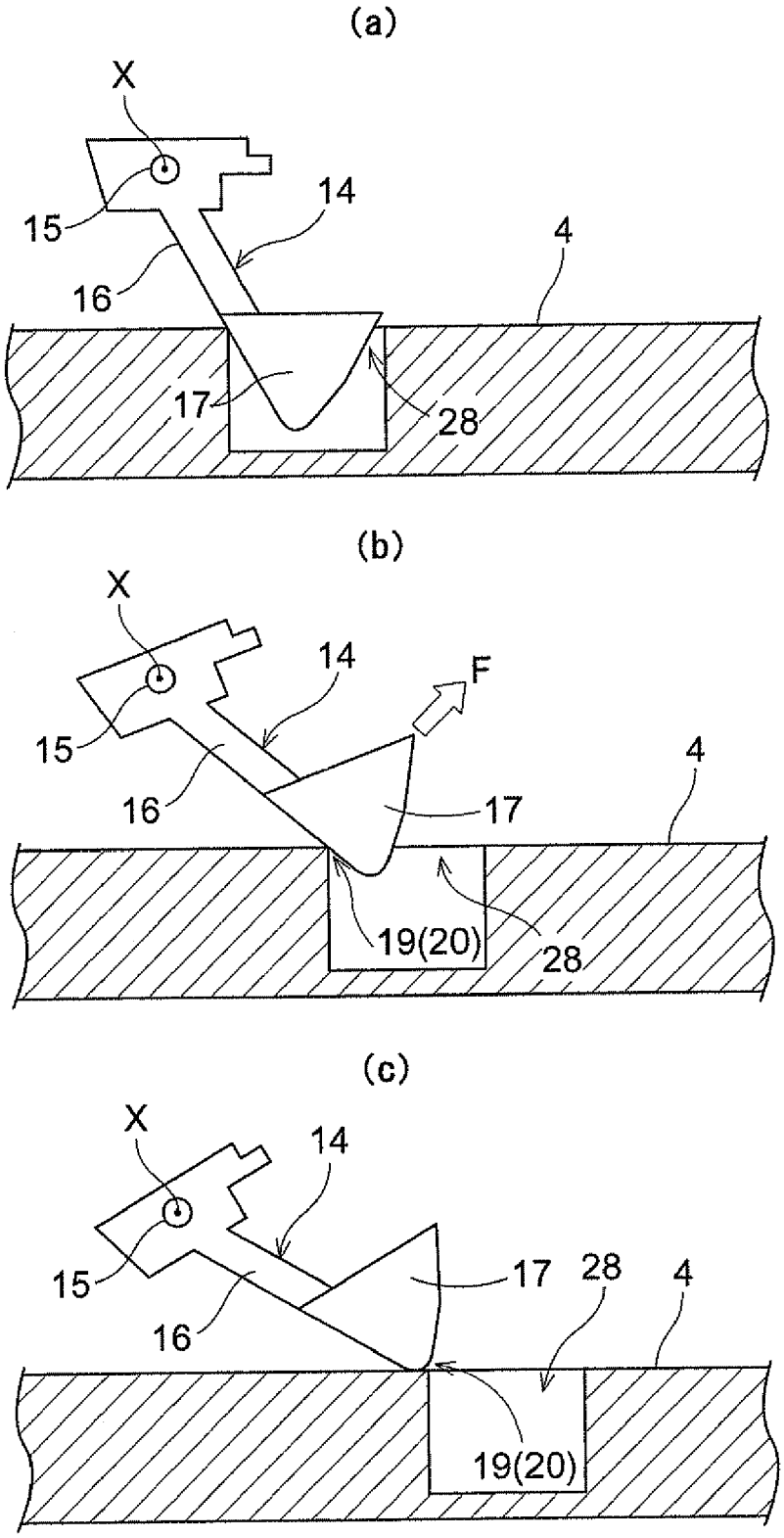
FIG. 7 is a series of explanatory views showing operation of the paper feeder in a second embodiment.

FIG. 7 is an explanatory view showing operation of the paper feeder in the second embodiment of the present invention. In this second embodiment, a recess 28 is formed in the upper surface of the bottom plate 4 instead of the through bore 18 in the first embodiment, for receiving the detecting member 17 of the actuator 14 having the same shape as the through bore 18 when viewed from top.

Other parts of the construction are the same as in the first embodiment.

Third Embodiment

Figure 8:
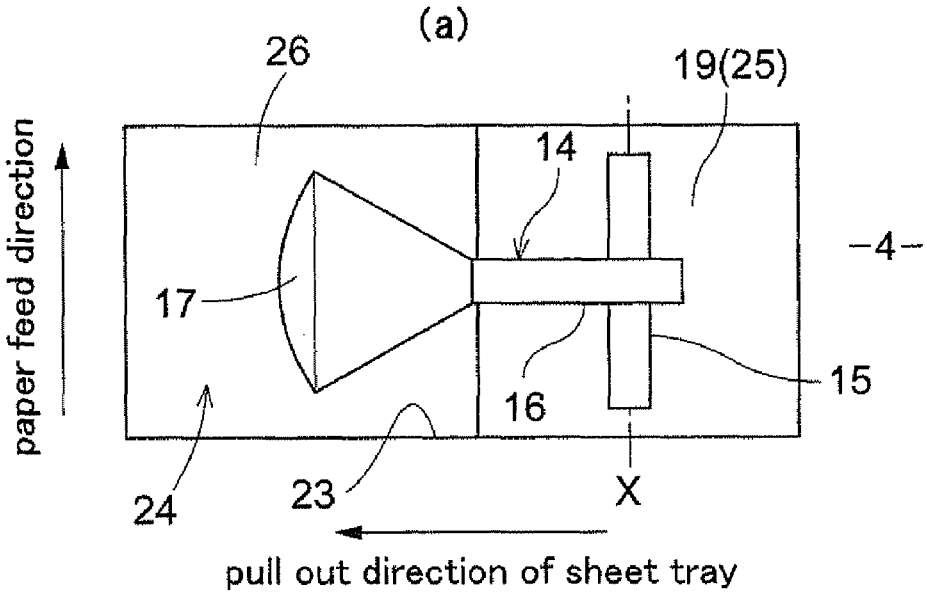
FIG. 8(*a*) is a top plan view of a principal portion of a paper feeder in a third embodiment.
Figure 8:
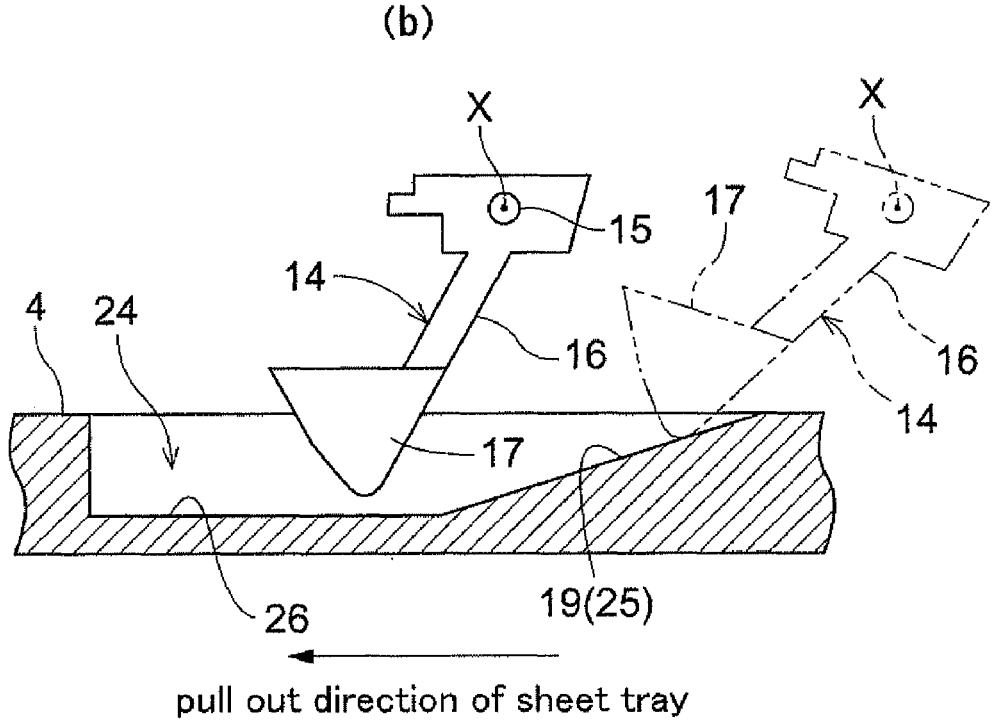

FIG. 8 shows a push-out guide 19 in the third embodiment of the present invention. In this third embodiment, the sensor unit 13 is mounted on the main body 1 with the axis X of the actuator 14 extending generally perpendicular to the pull-out direction of the sheet tray 3. The actuator 14 extends generally along the pull-out direction of the sheet tray 3 and is supported to be oscillatable. A recess 24 is formed in the upper surface of the bottom plate 4 for receiving the detecting member 17 of the actuator 14 when sheets are absent from the sheet tray 3. As shown in FIG. 8, the sheet sensor 12 can detect that sheets are absent from the sheet tray 3 based on an oscillated position of the actuator 14 when the detecting member 17 lies in the recess 24.

A push-out guide 19 is provided on peripheries 23 of the recess 24 to be capable of contacting a side surface of the detecting member 17 lying in the recess 24 to push the actuator 14 upward out of the recess 24 as the sheet tray 3 is pulled out of the main body 1.

As shown in FIG. 8(*a*), the push-out guide 19 includes the recess 24 having a generally rectangular shape as viewed from top, with a pair of side wall portions extending generally perpendicular to the direction for pulling the sheet tray 3 out of the main body 1. A wall surface 25 of one of the pair of the side wall portions of the recess 24 opposed to each other in the pull-out direction is provided to face the detecting member 17 lying in the recess 24 from an upstream side in the pull-out direction. As shown in FIG. 8(*b*), the wall surface 25 is formed as an inclined wall surface such that the height measured from the bottom 26 of the recess 24 progressively increases toward the upstream side of the pull-out direction.

Therefore, as shown in imaginary lines in FIG. 8(*b*), the inclined wall surface 25 contacts the side surface of the detecting member 17 to oscillate the actuator 14 about the axis X extending generally along the pull-out direction due to the push-out operation. As a result, the actuator 14 can be pushed upward out of the recess 24 while alleviating a shock caused by collision between the detecting member 17 and the peripheries of the bottom plate.

Other parts of the construction are the same as in the first embodiment.

Fourth Embodiment

Figure 9:
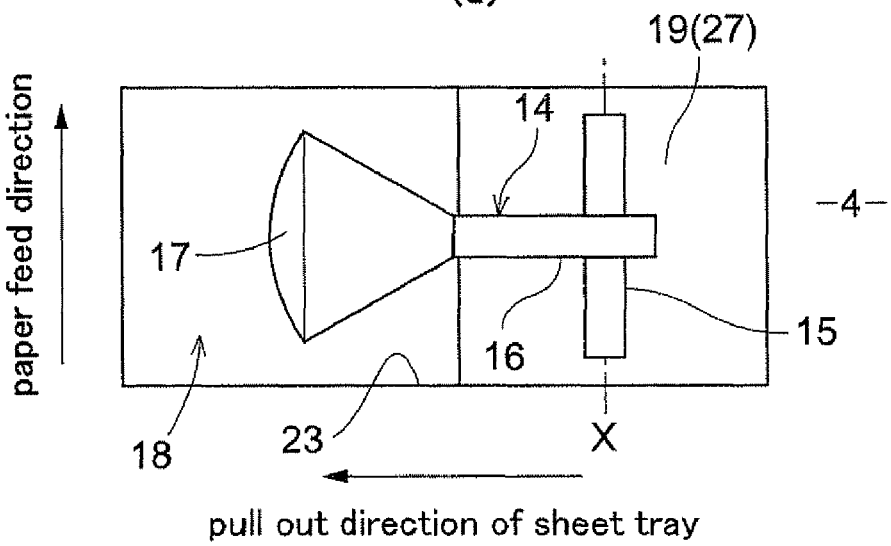
FIG. 9(*a*) is a top plan view of a principal portion of a paper feeder in a fourth embodiment.
Figure 9:
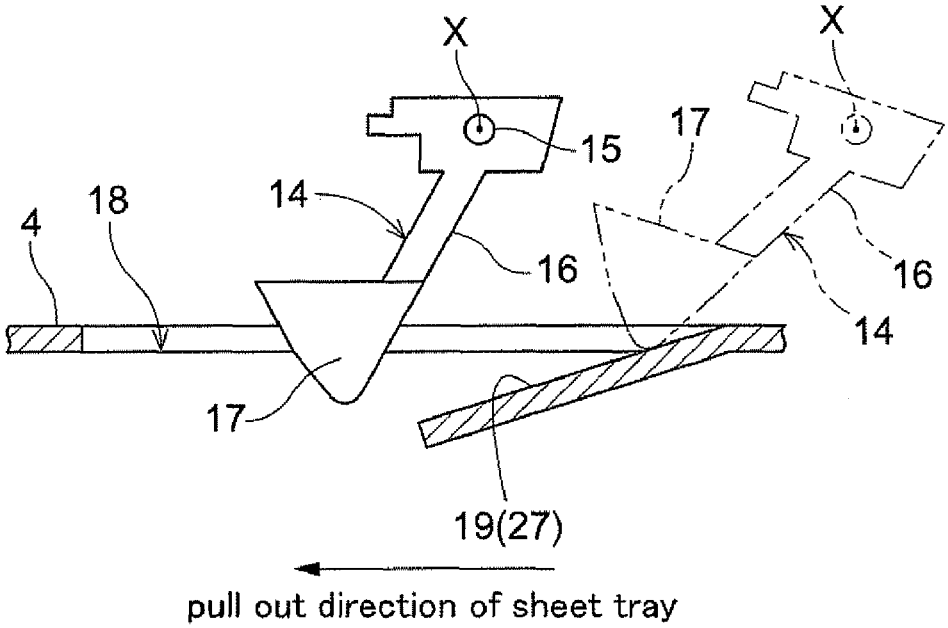

FIG. 9 shows a push-out guide 19 in the fourth embodiment. In this fourth embodiment, as an alternative to the rectangular recess 24 for receiving the detecting member 17 shown in the third embodiment, a generally rectangular through bore 18 having the same shape as the recess 24 as viewed from-top is formed in the bottom plate 4 as shown in FIG. 9(*a*). Further, as shown in FIG. 9(*b*), the push-out guide 19 is provided by a bottom plate portion 27 bent downward which is formed in a bore side edge portion to face the detecting member 17 lying in the through bore 18 from an upstream side in the pull-out direction.

It should be noted that the bottom plate portion 27 formed in the bore side edge portion to be bent downward corresponds to the wall surface 25 in the third embodiment that is formed in the side wall portion as the inclined wall surface to be progressively higher toward the upstream side of the pull-out direction.

Other parts of the construction are the same as in the third embodiment.

Other Embodiments

1. The paper feeder in accordance with the present invention may comprise a bottom plate mounted inside the sheet tray to be vertically movable by vertical oscillation, and an elevating device for vertically moving the bottom plate by drive oscillation.
2. The paper feeder in accordance with the present invention may be provided for image forming apparatus other than an electrophotographic copier, such as a printer, facsimile machine, etc.

What is claimed is:

1. A paper feeder comprising:

a sheet tray provided along a guide portion mounted on a main body of an image forming apparatus and capable of being pushed in and pulled out in horizontal directions with respect to the main body;

a bottom plate provided inside the sheet tray to be vertically movable;

an elevating device for raising the bottom plate as the sheet tray is pushed into the main body and lowering the bottom plate as the sheet tray is pulled out of the main body;

the main body having an actuator capable of contacting an upper surface of a sheet placed on the bottom plate as the bottom plate is raised, and a sensor capable of detecting the sheet on the sheet tray based on the actuator contacting the upper surface of the sheet;

a through bore or a recess formed in the bottom plate for receiving the actuator when the sheet tray is empty of a sheet, for enabling the sensor to detect that the sheet tray is empty of a sheet;

the actuator being oscillatable about an axis extending generally along a pull-out direction of the sheet tray; and a push-out guide provided on peripheries of the through bore or the recess for contacting the actuator lying in the through bore or the recess as the sheet tray is pulled out, thereby pushing the actuator upward out of the through bore or the recess, the push-out guide including an edge portion of peripheries of the through bore or the recess for facing the actuator lying in the through bore or the recess from an upstream side in the pull-out direction, the edge portion being formed in a direction inclined with respect to the pull-out direction and a sheet-feeding direction.

* * * * *